United States Patent [19]

Stump

[11] 4,068,712

[45] Jan. 17, 1978

[54] WIRE-LINE RETRIEVABLE, MECHANICALLY OPERATED SPOT VALVE

[75] Inventor: L. G. Stump, Odessa, Tex.

[73] Assignee: Sun Oil Company, Dallas, Tex.

[21] Appl. No.: 745,312

[22] Filed: Nov. 26, 1976

[51] Int. Cl.[2] ..... E21B 33/16; E21B 43/00

[52] U.S. Cl. ..... 166/156; 166/317; 166/332

[58] Field of Search ..... 166/133, 188, 317, 156, 166/332

[56] References Cited

U.S. PATENT DOCUMENTS

| | | | |
|---|---|---|---|
| 2,776,015 | 1/1957 | Bielstein | 166/188 |
| 2,854,929 | 10/1958 | McGowen, Jr. et al. | 166/188 |
| 2,999,545 | 9/1961 | Bigelow | 166/153 |
| 3,473,609 | 10/1969 | Allen | 166/317 |
| 3,530,935 | 9/1970 | Garrett | 166/317 |

*Primary Examiner*—James A. Leppink

*Attorney, Agent, or Firm*—J. Edward Hess; Donald R. Johnson; James H. Phillips

[57] ABSTRACT

In order to accurately place a charge of chemical in an old or established oil well or the like, tubing with a seating nipple affixed to its lower end is ran to the desired depth of placement, the charge of chemical is introduced into the tubing, and a spot valve according to the invention is placed into the tubing and pumped downhole until it is rammed home against the seating nipple, thereby expelling the chemical at the desired position in the well. The tubing is subsequently pulled upwardly for a few lengths, and the spot valve is then retrieved with a fishing tool. The spot valve includes a ball valve which is first held closed by a shear pin. The pin shears upon sufficient pull of the fishing tool to open the ball valve whereby the pressure is released across the ball permitting the spot valve to be retrieved with the fishing tool. After the spot valve is pulled, the remaining tubing is withdrawn from the well.

6 Claims, 10 Drawing Figures

WIRE-LINE RETRIEVABLE, MECHANICALLY OPERATED SPOT VALVE

FIELD OF THE INVENTION

Figure 1A:
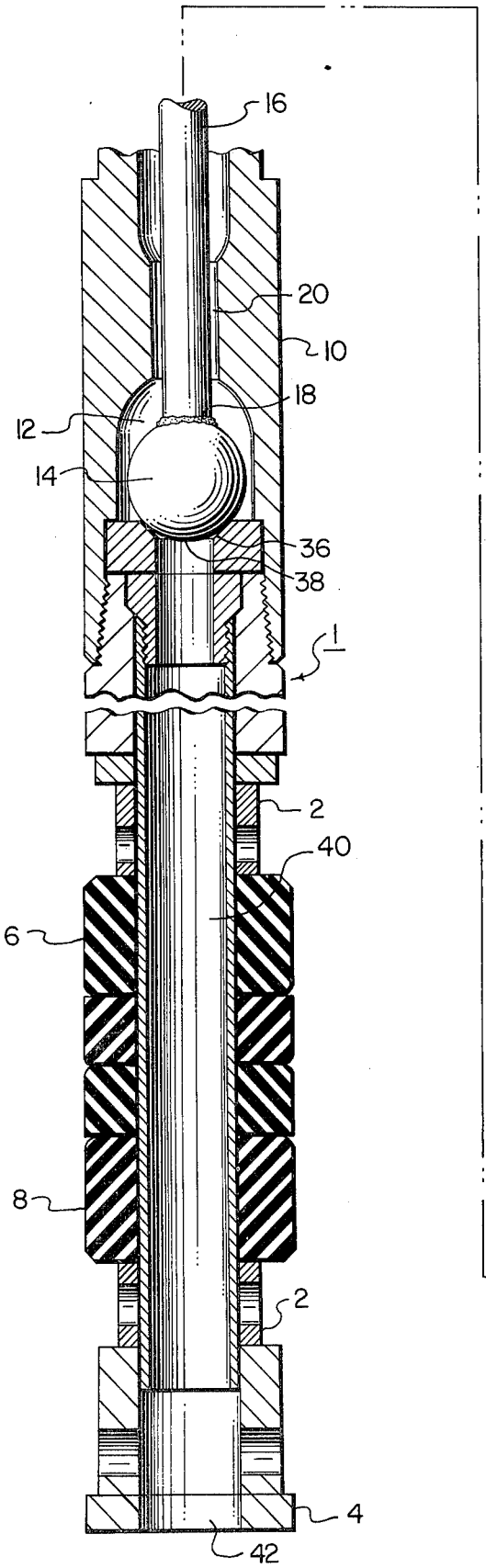

This invention relates to the well treatment arts, and more particularly, to means for placing a chemical charge accurately at a predetemined position in the well under conditions in which ordinary circulation techniques are difficult or impossible.

BACKGROUND OF THE INVENTION

For various reasons which are well known in the art, it is useful or necessary from time to time to spot acid or some other chemical in a particular place downhole in a well (such as an oil well). For example, hydrochloric acid, which will dissolve more than 10 cubic feet of rock per thousand gallons of 15% acid concentration, the usual strength employed, is used to work on natural or induced fractures in limestone or dolomite. The acid is usually put into the tubing and is followed by water to force the acid down the tubing to the formation being treated. This water and the acid that has been "spent" on the formation rocks must be carefully placed. Similarly, it may be desirable to employ certain chemicals in a "soak" mode in order to remove corrosion, scale, or the like from the casing walls. Again, accuracy of placement is an absolute necessity for obtaining meaningful results. Those skilled in the art will appreciate that such spotting operations are normally carried out by utilizing techniques in which circulation to the surface is obtained. That is, a pump forces fluid down the tubing and back up through the casing to the surface to be overboarded or recirculated. The known volumes of the tubing and casing permit accurate spotting to be obtained by simple calculation of the displacement of fluid pumped into the casing after the chemical charge has been introduced therein.

However, in some old or established wells, it is impossible or prohibitively difficult to obtain such circulation because of a loss of bottom hole pressure resulting from the age of the well or the type of formation being produced. Additionally, in some new wells, it is undesirable to spot a fluid in hole because of the extra amount of load water required to do so. By using the subject tool, trip time can be significantly cut down on work-overs.

Thus, those skilled in the art will appreciate that it would be highly desirable to achieve accurate chemical spotting in a well within which circulation-to-the-surface techniques cannot economically be employed in the usual manner.

It is therefore a broad object of my invention to provide improved means for spot treating an oil well or the like downhole with liquid chemicals.

It is another object of my invention to provide such means which may be employed without the necessity for achieving fluid circulation to the surface.

Still another object of my invention is to provide such means which is simply and reliable in operation and which is economical to fabricate.

BRIEF SUMMARY OF THE INVENTION

These and other objects of the invention are achieved by utilizing a spotting tool which is characterized by a ball valve held normally closed by a shear pin. The spotting tool, which tightly fits the tubing, is introduced into the tubing after the slug of chemicals has been poured therein and is pumped down the tubing to seat at its lower end which is partially closed off by an ordinary seating nipple. The tubing will have previously been ran to the desired depth for placing the chemical charge, such that, once the spotting tool rams home against the seating nipple, the chemical charge will have been expelled in the desired position. Subsequently, a few lengths of tubing are pulled and the spotting tool is retrieved by using a conventional sand line fishing tool which attaches to an upwardly directed rod extending from the spotting tool. The rod is welded to the ball valve whereby the shear pin can be sheared with an appropriate jerk on the wireline. This action unseats the ball valve to equalize the pressure across the tool which thereafter may be easily withdrawn from the tubing. After the spotting tool is removed from the tubing, the tubing itself is pulled from the casing to complete the chemical charge placement operation.

Figure 1B:
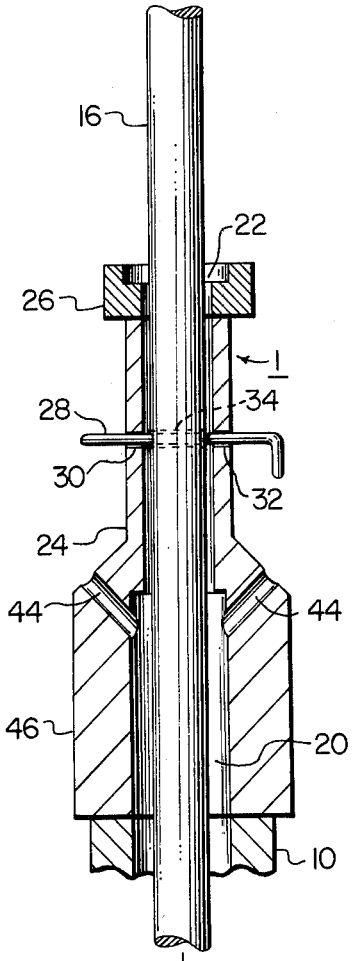

The subject matter of the invention is particularly pointed out and distinctly claimed in the concluding portion of the specification. The invention, however, both as to organization and method of operation, may best be understood by reference to the following description taken in conjunction with the accompanying drawings of which:

FIGS. 1 and 1B, taken together, present a cross-sectional view of a spotting tool according to the present invention; and FIGS. 2–9 illustrate successive operations within an oil well by which a liquid chemical charge is spotted by employing the tool shown in FIGS. 1 and 1B.

Referring now to FIGS. 1A and 1B which, taken together, illustrate an exemplary embodiment of the spotting tool according to the present invention, it will be observed that the lower section of the tool comprises a mandrel 2 terminating at its lower end with a no-go 4. Opposed seal cups 6, 8, are disposed intermediate the length of the mandrel 2. As will become more readily apparent as the description of the invention proceeds, the seal 6 is oriented to seal against fluid pressure from above when the tool 1 is inserted into tubing. Similarly, the seal 8 is oriented to seal against fluid pressure directed upwardly.

A valve housing section 10 of the tool 1 is disposed above and fixed to the mandrel section 2 and includes a cavity 12 containing a ball valve 14. A rod 16 is affixed to the top of the ball valve 14 by a weld 18. The rod 16 extends upwardly through an axial passage 20 in the upper section 10 of the tool 1 and out through an opening 22 in a fishing neck 24 which caps the tool 1. The fishing neck 24 is provided with an uppermost shoulder 26 which may be employed to retrieve the tool as set forth more particularly hereinafter. A shear pin 28, typically fabricated from brass, extends diametrically through aligned apertures 30, 32 in the sidewalls of the fishing neck 24 intermediate along the length thereof. The shear pin 28 also extends through a corresponding diametrically oriented hold 34 through the rod 16 whereby, when the shear pin 28 is in place, the rod 16 is rigidly longitudinally fixed in position within the upper section 10 of the tool 1. As a result, the lower portion of the ball valve 14 is sealingly seated within a valve seat 38 which terminates the upper end of the mandrel section 2 of the tool 1.

The central portion 38 of the valve seat 36 is open for fluid communications with a passage 40 which extends longitudinally downwardly terminating at its lower end as a centrally disposed opening 42 in the no-go 4. As shown in FIG. 1B, the axial passage 20 is in communication with the exterior of the tool 1 proximate the upper end thereof by passages 44 which are bored through the fishing neck walls to open above the lower shoulder portion 46 thereof. Thus, it will be understood that if the ball valve 14 is lifted from its seat 36, a fluid path extends between the opening 42 in the no-go 4 at the bottom end of the tool 1 through the passage 40, across the seat 36 and around the ball valve 14, through the passage 20 around rod 16 and out the passages 44 to the exterior of the tool 1 proximate its upper end.

Attention is now directed to FIGS. 2-9 which depict a series of operational steps by which the spotting tool of the present invention may be employed to spot place, with great accuracy, a chemical slug in a well in which circulation to the surface cannot be effected or, for one reason or another, such circulation is difficult or undesirable.

Figure 2:
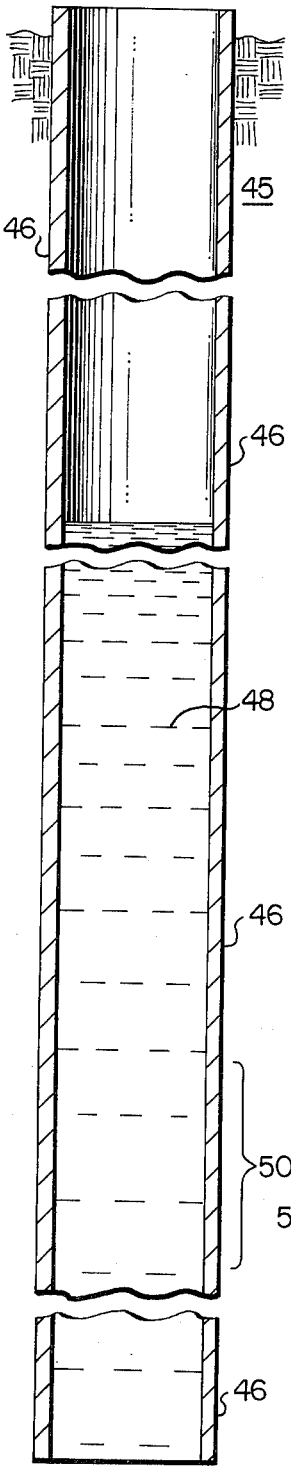

In FIG. 2, a well 45 is shown with a casing 46 partially filled with a fluid 48 such as oil or salt water or a mixture thereof. The well 45 is depicted as having all apparatus disposed within the casing removed in anticipation of effecting treatment in a predetermined region 50 with a slug of liquid chemical. While those skilled in the art will understand that the treatment to be carried out in the region 50 might well involve fluid communication with the adjacent formation outside the casing 46, no perforations or the like are shown in FIGS. 2-9 because the invention finds use in other chemical treatment processes, such as descaling, and the simpler presentation affords more clarity for best understanding of the invention.

Figure 3:
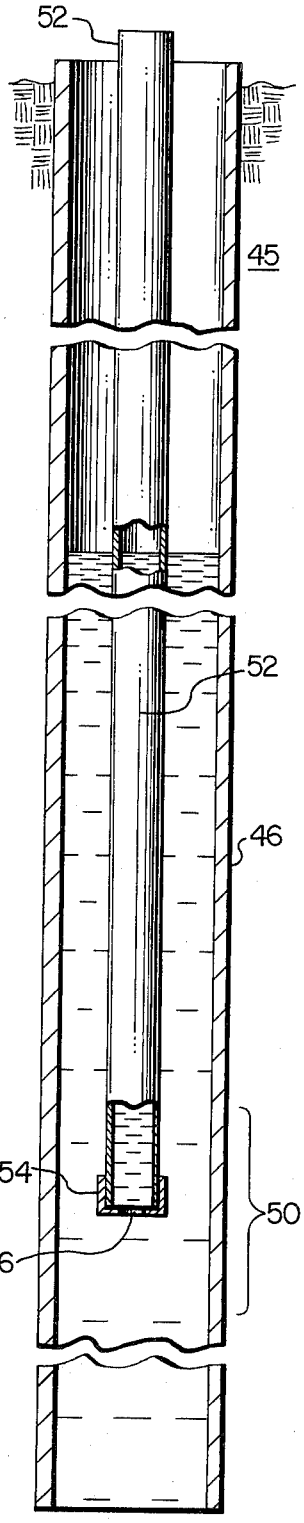
Figure 4:
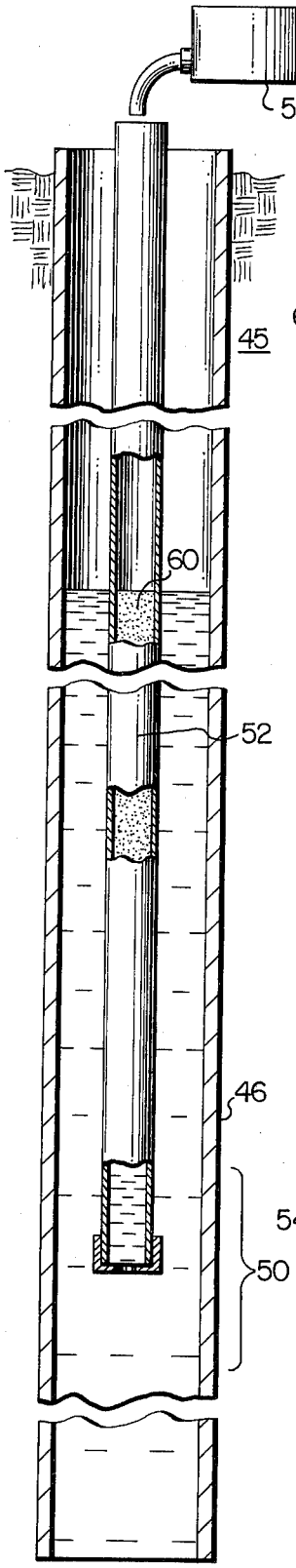

Referring now to FIG. 3, it will be observed that a tubing 52, terminating at its lower end in a seating nipple 54 having an opening 56 therein, has been run into the well 45. The tubing 52 is supported (by means not shown) with the lower end disposed within the region 50 to be treated. It may be noted that all pumping wells are installed with a seating nipple on the bottom of the tubing string. Thus, a spot can be obtained without first pulling the tubing if the tubing point is known.

After the tubing 52 has been positioned with its lower end terminating in the region to be treated, a measured slug of acid 60, or other chemical to be employed, is withdrawn from a source 58 and introduced into the tubing 52. After the measured slug of liquid chemical 60 has been placed within the tubing 52, the tool of FIGS. 1A, 1B is started down into the tubing 52.

Figure 5:
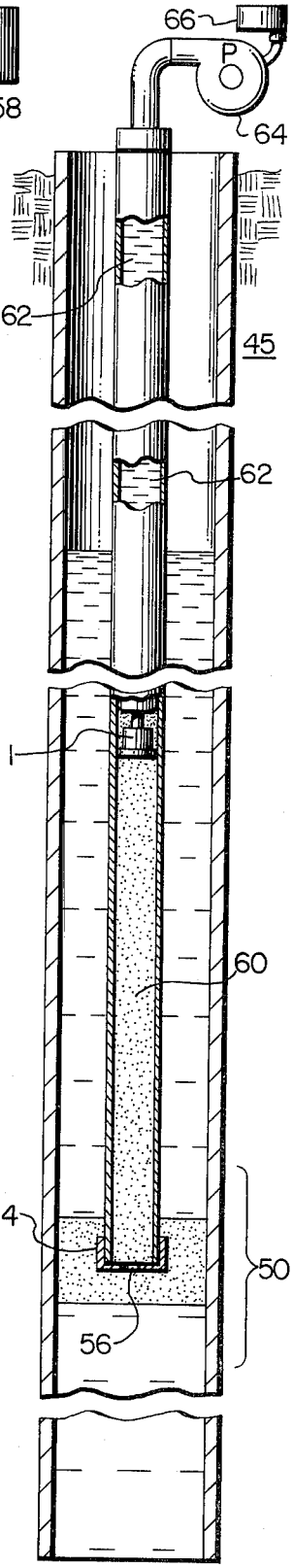

As shown in FIG. 5, the tool 1 is pumped down the tubing by a propelling fluid 62 which is pressurized by a pump 64 withdrawing propelling fluid from any suitable source 66. The propelling fluid may be oil, salt water, or the like or some common mixture routinely employed in such operations. As the tool 1 is forced downwardly by the pressurized propelling fluid 62, the acid 60 is forced out the opening 56 of the seating nipple 54 into the region 50 to be treated.

Figures 6, 7, 8, 9:
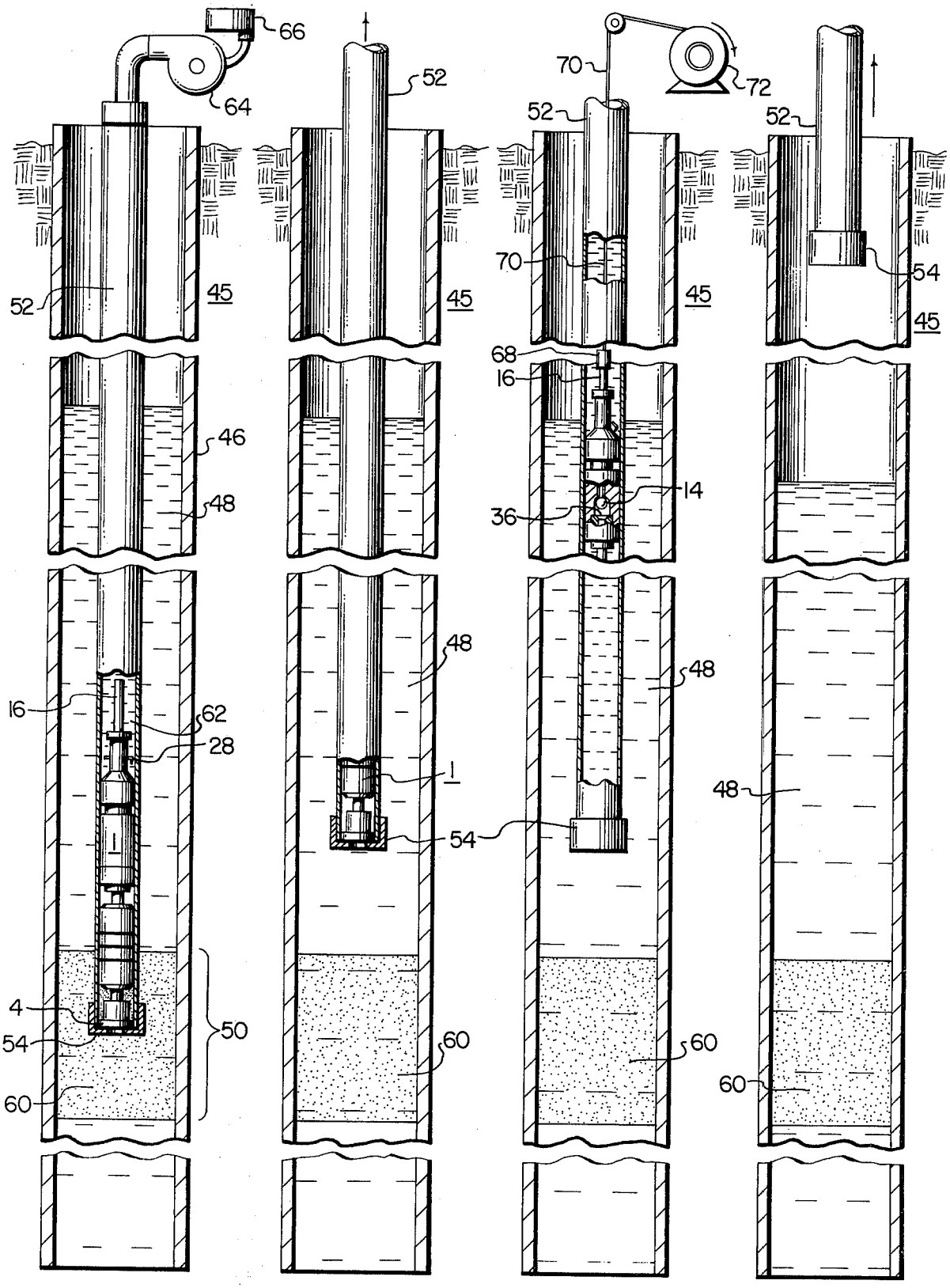

This pumping step continues until the no-go 4 of the tool 1 rams home against the seating nipple 54 to complete the expulsion of the liquid chemical 60 into the region 50 to be treated. At the completion of this step, the apparatus is situated as shown in FIG. 6. Subsequently, the tubing 52, with the tool 1 remaining in position at the bottom thereof, is withdrawn a few lengths until the seating nipple 54 is well clear of the slug of liquid chemical 60 which has now been placed. It is now necessary to release the pressure differential across the tool 1 in order that it can be withdrawn from the tubing 52. This step is carried out by introducing an ordinary fishing tool 68, suspended by a cable 70 which may be pulled upwardly by a windless 72, into the tubing 52. When the fishing tool 68 has firmly captured the rod 16 (which, in effect, is treated as a lost sucker rod), a sharp pull on the rod 16 serves to fracture the shear pin 28 permitting the ball valve 14 to rise from its seat 36. As a result, a free liquid passage is open between the upper and lower portions of the tool which releases the pressure differential across the tool and permits its ready withdrawal up the tubing 52.

After the tool 1 has been withdrawn from the tubing 52 by means of the fishing tool 68 and cable 70 which is wound onto the windless 72, the tubing 52 is itself pulled from the casing 46 to complete the operation by which the slug of liquid chemical was precisely spotted within the region 50 to be treated.

While the principles of the invention have now been made clear in an illustrative embodiment, there will be immediately obvious to those skilled in the art, many modifications of structure, arrangements, proportions, the elements, materials, and components, used in the practice of the invention which are particularly adapted for specific environments and operating requirements without departing from those principles.

What is claimed is:

1. A spotting tool for use in placing a charge of liquid chemical downhole in a well by forcing the liquid chemical down a tubing string, having a seating nipple or the like affixed to its lower terminus, for expulsion from the lower terminus, said tool comprising:

A. an elongated, generally cylindrical housing having generally axially aligned passage therethrough extending between first and second ends thereof;

B. a valve disposed within said aligned passage intermediate the length thereof, said valve including a seat and a spherical moveable valve member for selectively engaging and disengaging said seat to correspondingly close and open said passage for fluid communication therethrough;

C. fluid seal means disposed circumferentially about said housing along at least a portion of the length thereof, said seal means being adapted to engage the internal walls of the tubing string and thereby effect a fluid seal in both axial directions therefrom;

D. actuator means coupled to said moveable valve member, said actuator means including an axially directed rod portion directly affixed to said moveable valve member and extending through said passage beyond said first end of said housing; and E. a frangible member adapted to transfix said actuator with said housing such that said spherical moveable valve member normally sealingly engages said valve seat;

whereby an axial force applied to said rod portion serves to part said frangible member, thereby permitting said actuator to release said spherical moveable valve member from said valve seat to establish a fluid communication path through said passage.

2. The tool of claim 1 in which said rod is welded directly to said moveable valve member.

3. A spotting tool for use in placing a charge of liquid chemical downhole in a well by forcing the liquid down a tubing string, having a seating nipple or the like affixed to its lower terminus, for expulsion from the lower terminus, said tool comprising:

A. an elongated, generally cylindrical having a generally axially aligned passage therethrough extending between first and second ends thereof;

B. a valve disposed within said aligned passage intermediate the length thereof, said valve including a seat and a moveable valve member for selectively engaging and disengaging said seat to correspondingly close and open said passage for fluid communication therethrough;

C. fluid seal means disposed circumferentially about said housing along at least a portion of the length thereof, said seal means being adapted to engage the internal walls of the tubing string and thereby effect a fluid seal in both axial directions therefrom;

D. actuator means coupled to said moveable valve member, said actuator means including an axially directed rod portion directly affixed to said moveable valve member and extending through said passage beyond said first end of said housing;

E. a frangible member adapted to transfix said actuator with said housing such that said moveable valve member normally sealingly engages said valve seat; and F. a diametrically directed aperture through said rod and corresponding radially directed and aligned apertures in the side walls of said housing, said apertures in said rod and said housing being substantially in alignment for receiving said frangible member when said moveable valve member is positioned to sealingly engage said valve seat;

whereby an axial force applied to said rod portion serves to part said frangible member, thereby permitting said actuator to release said moveable valve member from said valve seat to establish a fluid communication path through said passage.

4. The tool of claim 3 wherein said frangible member comprises a shear pin adapted to extend through said apertures in said rod and said housing sidewalls when the said apertures are aligned.

5. The tool of claim 4 in which said housing is terminated at its said first end by a fishing neck.

6. The tool of claim 5 in which said housing is terminated at its said second end by a no-go adapted to seat against the tubing string seating nipple.

* * * * *